US007250062B2

(12) United States Patent
Lemaire et al.

(10) Patent No.: US 7,250,062 B2
(45) Date of Patent: Jul. 31, 2007

(54) METHOD FOR REMOVING HORN SUBSTANCES FROM ANIMAL SKIN

(75) Inventors: Hans-Georg Lemaire, Limburgerhof (DE); Tilman Luedecke Taeger, Seeheim-Jugenheim (DE); Gunther Pabst, Neumarkt (DE); Philippe Lamalle, Lambsheim (DE); Michael Breuer, Limburgerhof (DE); Burkhard Kroeger, Limburgerhof (DE); Thomas Subkowski, Ladenburg (DE)

(73) Assignee: BASF Aktienegesellschaft, Ludwigshafen (DE)

( * ) Notice: Subject to any disclaimer, the term of this patent is extended or adjusted under 35 U.S.C. 154(b) by 0 days.

(21) Appl. No.: 10/531,167

(22) PCT Filed: Oct. 14, 2003

(86) PCT No.: PCT/EP03/11326

§ 371 (c)(1),
(2), (4) Date: Apr. 11, 2005

(87) PCT Pub. No.: WO2004/038046

PCT Pub. Date: May 6, 2004

(65) Prior Publication Data

US 2006/0037148 A1 Feb. 23, 2006

(30) Foreign Application Priority Data

Oct. 21, 2002 (DE) ..... 102 49 077
Apr. 28, 2003 (DE) ..... 103 19 240

(51) Int. Cl.
*C14C 1/06* (2006.01)

(52) U.S. Cl. ..... 8/94.16; 8/94.15

(58) Field of Classification Search ..... 8/94.16, 8/94.15, 94.1 R, 94.1
See application file for complete search history.

(56) References Cited

U.S. PATENT DOCUMENTS

| | | | | |
|---|---|---|---|---|
| 1,973,130 | A | 9/1934 | Turley | |
| 3,865,546 | A | 2/1975 | Zemlin et al. | |
| 4,278,432 | A * | 7/1981 | Monsheimer et al. | 8/94.18 |
| 4,294,087 | A * | 10/1981 | Monsheimer et al. | 69/21 |
| 4,472,569 | A | 9/1984 | Gray et al. | |
| 4,484,924 | A * | 11/1984 | Pfleiderer et al. | 8/94.17 |
| 2006/0037148 | A1 | 2/2006 | Lemaire et al. | |

FOREIGN PATENT DOCUMENTS

| | | |
|---|---|---|
| DE | 21 31 630 | 1/1972 |
| DE | 29 17 376 | 11/1980 |
| EP | 0 095 916 | 12/1983 |
| EP | 0 096 521 | 12/1983 |
| FR | 1126252 | 11/1956 |
| WO | 96/19560 | 6/1996 |
| WO | 96 19590 | 6/1996 |
| WO | 03 097880 | 11/2003 |

OTHER PUBLICATIONS

Herfeld, "Bibliothek des Leders", vol. 2, p. 62-167, 1998.
Heidemann, E.: "Fundamentals of Leather Manufacturing", E. Roether KG Druckerei und Verlag, Darmstadt, p. 165-218 and 253, 1993.
Thanikaivelan, P.: "Development of A Lether Processing Method in Narrow pH Profile", Journal of the Society of Leather Technologist and Chemists, vol. 84, p. 276-284, 2000.
Clara, S.: "Novel Unhairing Enzymes" Journal of BLC Leather Technology Center, p. 83-85, May 2002.
Lee, H.: "Characterization of a Keratinolytic Metalloprotease from Bacillus sp. SCB-3" Applied Biochemistry and Biotechnology, vol. 97, p. 123-133, 2002.
Yamamura, Shohei: "Keratin degradation: a cooperative action of two enzymes from Stenotrophomonas sp." Biochemical and Biophysical Research Communications, vol. 294, No. 4, p. 1138-1143, 2002.
Rozs, M.: "Fermentation characteristics and secretion of proteases of a new keratinolytic strain of *Bacillus licheniformis*" Biotechnology Letter, vol. 23, p. 1925-1929, 2001.
Boeckle, Brigitte: "Characterization of a Keratinolytic Serine Proteinase from *Streptomyces pactum* DSM 40530" Applied and Environmental Microbiology, vol. 61, No. 10, p. 3705-3710, Oct. 1995.
Kunert, J.: "Effect of reducing agents on proteolytic and keratinolytic activity of enzymes of *Microsporum gypseum*" Mycoses, vol. 35, p. 343-348, 1992.
Hinshelwood, Sir Cyril: Journal of The Chemical Society, p. 248-255, 1949.
U.S. Appl. No. 10/579,714, filed May 17, 2006, Buehler et al.

* cited by examiner

*Primary Examiner*—Lorna M. Douyon
*Assistant Examiner*—Amina Khan
(74) *Attorney, Agent, or Firm*—Oblon, Spivak, McClelland, Maier & Neustadt, P.C.

(57) ABSTRACT

The invention relates to a method for removing horn substances from animal skin. The method is characterized in that animal skins are treated in an aqueous bath containing between 0.05 and 5 wt. %, in relation to the weight of the salt, of at least one compound of general formula I or the corresponding alkali metallic salts or alkaline-earth metallic salts thereof or ammonium or phosphonium salts. The aqueous bath also comprises at least one compound which catalyses the hydrolysis of peptide compounds (I)

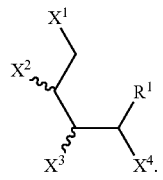

14 Claims, No Drawings

METHOD FOR REMOVING HORN SUBSTANCES FROM ANIMAL SKIN

The present invention relates to a process for removing horny substances from animal hides, wherein animal hides are treated in an aqueous liquor comprising from 0.05 to 5% by weight, based on the salted weight, of one or more compounds of the formula I

I

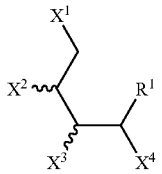

or the corresponding alkali metal or alkaline earth metal salts or ammonium or phosphonium salts thereof, the variables being defined as follows:

$R^1$ is selected from hydrogen and $C_1$-$C_{12}$-alkyl, unsubstituted or substituted by one or more S—H or O—H groups;

$X^1$ to $X^4$ are identical or different and are selected from hydrogen, $C_1$-$C_4$-alkyl, O—H, S—H and N—$HR^2$, $R^2$ is hydrogen or $C_1$-$C_{12}$-alkyl or a $C_1$-$C_4$-alkyl-C═O group, at least one of the radicals $X^1$ to $X^4$ being S—H, and, if $R^1$ contains neither O—H nor S—H, at least one further radical from among $X^1$ to $X^4$ is selected from S—H, OH and NH—$R^2$, and furthermore comprising at least one compound which catalyzes the hydrolysis of peptide bonds.

Animal hides have been processed to leather since antiquity. Before it is possible to begin the actual leather production, the tanning, the animal hides must be prepared. This preparation generally takes place in the beam house and comprises numerous operations. Most of these operations serve for separating off those components of the animal hides which are undesired in the subsequent leather production or in the subsequent leather. The undesired components generally include, for example, the hairs together with the hair roots. The unhairing of the animal hides is usually assisted by chemicals. A distinction is made between oxidative, reductive and enzymatic unhairing methods. An overview of methods can be found in Herfeld, Bibliothek des Leders, Vol. 2, 1988, pages 62-167 and in E. Heidemann, Fundamentals of Leather Manufacturing, E. Roether K G Druckerei und Verlag, Darmstadt 1993, pages 165-218.

In general, the unhairing of the animal hides is effected substantially or completely during the liming or the painting. Conventional unhairing reagents which are advantageous in production are $Na_2S$ and NaSH, the latter often also being referred to as sodium sulfhydrate. Both salts can be used in highly contaminated form, and technical-grade $Na_2S$ generally has an $Na_2S$ content which does not exceed 65% by weight and technical-grade NaHS usually contains 70-72% by weight of NaHS. Both, $Na_2S$ and NaHS, have disadvantages in practical use. For safety reasons, $Na_2S$ and NaHS can be used only in a strongly alkaline medium because, under acidification, they evolve toxic and foul-smelling hydrogen sulfide. For ecological and process engineering reasons, the elimination of the unconsumed sulfide, in particular of the sulfide-containing wastewaters, is a problematic step. If excess sulfide is precipitated, for example with $Fe^{2+}$ or $Fe^{3+}$, iron sulfide sludges which are expensive to separate off are obtained. It is also possible to attempt to convert sulfides into ecologically safe salts by oxidation with, for example, $H_2O_2$, but corrosion problems then have to be accepted.

There has therefore been no lack of attempts to use reagents other than $Na_2S$ or NaHS for the treatment of the animal hides. Most experiments start from volatile SH—containing organic reagents.

U.S. Pat. No. 1,973,130 describes the use of organic sulfur compounds in the presence of lime, (column 1, line 40) for unhairing, for example, calf hides. In particular, ethyl mercaptan is a foul-smelling reagent and ethyl mercaptan-containing wastewaters are difficult to work up, preventing the use of ethyl mercaptan in the beam house.

FR 1.126.252 describes the unhairing of animal hides by the action of thioglycolamide (example 1) or thioglycerol (example 2) in the presence of ammonium sulfate at a pH of 7-8.

However, attempts to substitute $Na_2S$ or NaHS by mercaptoacetic acid or mercaptoethanol or the alkali metal or alkaline earth metal salts thereof did not lead to success because both reagents and also their alkali metal and alkaline earth metal salts readily eliminate hydrogen sulfide and have an extremely unpleasant smell. Furthermore, beam house wastewaters comprising mercaptoacetic acid or mercaptoethanol or decomposition and secondary products are difficult to clarify and give up unpleasant odors.

The use of 1,4-dimercaptobutanediol-containing formulations for removing horny substances, in particular hairs, from living tissue is known from the cosmetics industry, for example for undesired beard growth. Thus, DE 21 31 630 shows that compositions comprising at least 0.25% by weight of dimercaptobutanediol and from about 0.01 to 40% by weight of a water-soluble guanidine compound and having a pH of less than 12 can be applied to guinea pigs in order to unhair them or to human horny skin in order to eliminate calluses, without causing skin irritations in guinea pigs or even erythremia (malignant proliferations of the formative system of the red blood corpuscles). The epidermis is preserved in the treatment described in DE 21 31 630.

EP-A 0 095 916 discloses the use of formulations comprising aminoethanethiol and 1,4-dimercaptobutanediol and an aminoguanidine or diguanidine compound for eliminating undesired human body and facial hair. On page 2, line 1, it is stated that small thiol molecules are preferably suitable for producing rapid unhairing because they penetrate more rapidly into the skin. The epidermis is preserved in the treatment described in EP-A 0 095 916.

EP-A 0 096 521 discloses the use of formulations comprising, for example, 1,4-dimercaptobutanediol and an aminoguanidine or diguanidine compound for eliminating undesired human body and facial hair. The epidermis is preserved in the treatment described in EP-A 0 096 521.

It is furthermore known that collagen can be modified by opening S—S bridges in the collagen by reaction with dithioerythrol and subsequent chlorination with chloroacetamide or chloroacetic acid, cf. for example E. Heidemann, Fundamentals of Leather Manufacturing, E. Roether K G Druckerei und Verlag, Darmstadt 1993, page 253. Furthermore, protein solutions can be conserved by adding dithioerythrol or dithiothreitol. The conservation is based on a type of protection from oxidation, because dithioerythrol is usually the first to be oxidized instead of the protein SH groups.

DE 29 17 376 C2 discloses that animal hides can be unhaired using enzymes in the presence of compounds of the formula A1 or A2

A1

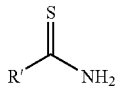

A2

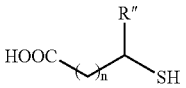

Here, R' are selected from hydrogen, an amino group and alkyl radicals of 1 to 6 carbon atoms, n is from 0 to 6 and R" is an alkyl radical of 1 to 6 carbon atoms. The animal hides are treated first in the acidic pH range with thioglycolic acid (example 1), mercaptoacetic acid (example 2) or mercaptoethanol and thioglycolic acid (example 3) or a combination of thioglycolic acid and thiourea. However, the pretreatment compositions have a very unpleasant odor.

WO 96/19560 proposes unhairing cattle hides by means of 2 different enzymes and dithiothreitol (example 2, page 14, lines 10 to 12), the hairs being preserved; however, no instructions for carrying out the proposed process are disclosed.

It is an object of the present invention to provide a process for removing horny substances from animal hides and for removing the epidermis very substantially in the same operation, in which as few as possible of unpleasant odors are given off. In particular, it is an object of the present invention to provide a process for removing horny substances so that they are very substantially destroyed.

We have found that this object is achieved and that the process defined at the outset is very suitable for removing horny substances from animal hides and for removing the epidermis very substantially in the same operation, and that the reagents used give off few or no unpleasant odors.

In the context of the present invention, horny substances are understood as meaning calluses, feathers, nail and claw parts and in particular hairs of animals.

The animal hides may contain residues of flesh of the relevant animals. What is essential to the invention, however, is that they contain horny substances. The amount of horny substance, based on the total weight of the animal hide, is not critical. The novel process is suitable both for removing large amounts of horny substance and for removing small hair residues.

In the context of the present invention, animal hides are understood as meaning not only hides of slaughtered animals or animals deliberately killed in another manner but also hides of those animals which have died as a result of accidents, for example traffic accidents or fights with members of the same species or other animals, or through natural causes, such as age or disease.

In the context of the present invention, the animal hides are usually hides of vertebrates, e.g. cattle, calves, pigs, goats, sheep, lambs, elks, game, such as stags or does, and furthermore birds, for example ostriches, fish or reptiles, such as snakes.

The following procedure is advantageously followed for carrying out the novel process.

Animal hides are treated with from 0.05 to 5% by weight, based on the salted weight, of one or more compounds of the formula I

I

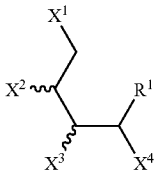

or the corresponding alkali metal or alkaline earth metal salts or ammonium or phosphonium salts, the radicals in formula I being defined as follows:

$R^1$ is selected from $C_1$-$C_{12}$-alkyl, such as methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl or n-decyl, particularly preferably $C_1$-$C_4$-alkyl, such as methyl, ethyl, n-propyl, isopropyl, n-butyl, isobutyl, sec-butyl and tert-butyl;

$C_1$-$C_{12}$-alkyl, substituted by or more hydroxyl or thiol groups, such as hydroxymethyl, 2-hydroxyethyl, 1,2-dihydroxyethyl, 3-hydroxy-n-propyl, 2-hydroxyisopropyl, ω-hydroxy-n-butyl, ω-hydroxy-n-decyl, HS—$CH_2$—, HS—$(CH_2)_2$— or HS—$(CH_2)_3$—, and very particularly preferably hydrogen, $X^1$ to $X^4$ are identical or different and are selected from hydrogen, $C_1$-$C_4$-alkyl, such as methyl, ethyl, n-propyl, isopropyl, n-butyl, isobutyl, sec-butyl and tert-butyl, O—H, S—H or N—$HR^2$, in particular O—H or S—H, $R^2$ is hydrogen or $C_1$-$C_{12}$-alkyl, such as methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl or n-decyl, particularly preferably $C_1$-$C_4$-alkyl, such as methyl, ethyl, n-propyl, isopropyl, n-butyl, isobutyl, sec-butyl and tert-butyl;

or H—C═O or a $C_1$-$C_4$-alkyl-C═O group, for example acetyl, $C_2H_5$—C═O, n-$C_3H_7$—C═O, iso-$C_3H_7$—C═O, n-$C_4H_9$—C═O, iso-$C_4H_9$—C═O, sec-$C_4H_9$-C═O, tert-$C_4H_9$—C═O.

in the presence of at least one compound which catalyzes the hydrolysis of peptide bonds.

At least one of the radicals $X^1$ to $X^4$ is S—H and, if $R^1$ contains neither O—H nor S—H, at least one further radical from among $X^1$ to $X^4$ is selected from S—H, OH and NH—$R^2$.

Preferably, at least one group $X^1$ to $X^4$ is hydroxyl and particularly preferably at least two groups $X^1$ to $X^4$ are hydroxyl. Very particularly preferably, $X^2$ and $X^3$ are each hydroxyl. Very particularly preferably, $X^1$ and $X^4$ are each S—H and very particularly preferably $R^1$ is hydrogen.

Among the corresponding alkali metal and alkaline earth metal salts, in particular the mono- and disodium salts, mono- and dipotassium salts and potassium sodium salts of the compounds of the formula I may be mentioned, and furthermore the corresponding calcium and magnesium salts. The ammonium salts and primary, secondary, tertiary and in particular quaternary mono- and diammonium salts and phosphonium salts may also be mentioned. Of course, mixtures of compounds of the formula I and the corresponding alkali metal or alkaline earth metal salts or ammonium or phosphonium salts thereof can also be used.

Preferred mono- and diammonium salts have, as cations, those of the formula $N(R^3)(R^4)(R^5)(R^6)^+$, where $R^3$ to $R^6$ are in each case identical or different and are selected from hydrogen $C_1$-$C_{12}$-alkyl, phenyl and $CH_2$—$CH_2$—OH. Examples are tetramethylammonium, tetraethylammonium, methyldiethanolammonium and n-butyldiethanolammonium. Preferred mono- and diphosphonium salts have, as cations, those of the formula $P(R^3)(R^4)(R^5)(R^6)^+$, where $R^3$ to $R^6$ are as defined above.

Very particularly preferably, one or more 1,4-dimercaptobutanediols, selected from I a, I a' and I b, Ia

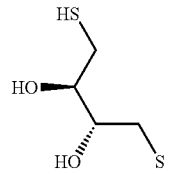

Ia'

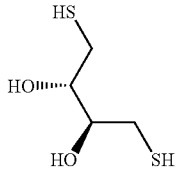

Ib

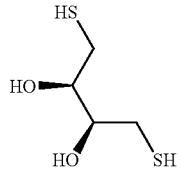

or the corresponding alkali metal or alkaline earth metal salts thereof are used. I a and I a' are referred to as dithiothreitol, and I b is also referred to as dithioerythrol. The use of racemic dithiothreitol is very particularly preferred. I a, I a' and I b are virtually odorless, readily meterable and readily water-soluble compounds.

The compounds I a or I a' and I b are known and are commercially available, for example, from Aldrich or ACROS Chemicals. Further members are synthesized as described in U.S. Pat. No. 4,472,569 or J. Chem. Soc. 1949, 248 or by analogous reactions.

At least one novel process is carried out in the presence of at least one compound which catalyzes the hydrolysis of peptide bonds.

At least one of these compounds is preferably an organic compound.

In the context of the present invention, compounds which catalyze the hydrolysis of peptide bonds are not to be understood as meaning Brönsted acids or the salts thereof.

In the context of the present invention, organic compounds which catalyze the hydrolysis of the peptide bonds are to be understood in particular as meaning enzymes. Exo and endopeptidases are preferred. These may be members of the main classes of proteases, for example serine proteases, cysteine proteases, metalloproteases and acid proteases.

An enzyme may be used.

Mixtures of 2 enzymes may be used.

Examples of serine proteases are trypsin, chymotrypsin, elastase, thrombin, plasmin, subtilisin and acrosin.

Examples of cysteine proteases are papain, bromelain and cathepsin B. Examples of metalloproteases are carboxypeptidase and ACE (angiotensin converting enzyme).

Examples of acid proteases (aspartate proteases) are pepsin and HIV protease.

Serine proteases, for example trypsin, chymotrypsin, subtilisin and proteinase K, and variants of the abovementioned enzyme are particularly suitable for the purposes of the present invention. Variants include, inter alia, mutants which have formed as a result of insertion(s), deletion(s) and point mutation(s) and have changed, in particular advantageous, properties in comparison with the protease used as a starting material in each case. Examples of changed properties are thermal stability, higher affinity to the substrate to be converted enzymatically, (higher) substrate specificity and a shift of the optimum pH into the desired pH range. In the context of the present invention, fragments of abovementioned proteases are also referred to as variants. The variants are prepared by a recombinant method using the conventional methods, e.g. those described in Molecular Cloning—A Laboratory Manual by Sambrook, Fritsch and Maniatis (1989), in a suitable bacterial or fungal host system. Proteases of the four main classes (serine proteases, cysteine proteases, metalloproteases and acid proteases) having specific keratinolytic activity and mixtures of these enzymes are very particularly preferred. In the context of the present invention, enzymes which hydrolyze peptide bonds are also to be understood as meaning commercially available enzyme formulations. Examples of such products are Alcalase 3.0T, Pyrase 250 MP, concentrated PTN 3.0 (type p) from Novozymes, Prozym 6 from TFL, pancreatin from Nordmark A, Pancreatina enzyme conc. from Scientific Protein Laboratory, Alprolase 3 m, Basozym® L10 and Basozym® S20 from BASF-Aktiengesellschaft, Batinase (producer: Genencor), Proleather (producer: Amano), Protease L 660 (producer: Genencor), Esperase (producer: Novo Nordisk), Alcalase 2.4L (producer: Novo Nordisk), Savinase (producer: Novo Nordisk) and Pruafect 4000 L (producer: Genencor).

If the abovementioned enzymes or variants of these enzymes are used alone or as mixtures in the novel process, not only is particularly good removal of horny substances achieved but also substantial or preferably complete degradation of the epidermis is observed.

In general, an amount of from 0.05 to 5% by weight, based on the hide weight or salted weight of the animal hides, of compound I is sufficient. From 0.1 to 1.5% by weight is preferred and from 0.25 to 1.0% by weight is particularly preferred.

The amount in which the compound which catalyzes the hydrolysis of peptide bonds is used, in particular the amount of enzyme used, is usually expressed in Löhlein-Volhard units (LVUs). Usually, instead of metering pure enzyme, dilute formulations which may be solid or liquid are metered.

The LVUs are determined by titrimetric methods which are known per se and are based on the degradation of casein by an enzyme formulation to be investigated or an enzyme to be investigated and subsequent titration of the liberated carboxyl groups with 0.1 N NaOH.

One LVU is equivalent to 0.00575 ml of 0.1 N NaOH.

According to the invention, from 500 to 2 000 000, preferably from 1 000 to 50 000, particularly preferably from 1 500 to 10 000, LVU/kg, based in each case on the salted weight of the animal hide to be treated, are metered.

A compound or compounds which catalyzes or catalyze the hydrolysis of peptide bonds is or are used as a rule in amounts which are at least a factor of 10, preferably 100, particularly preferably 1 000, smaller than the amount of compound I, based on pure compounds.

Particularly if the compound used is one or more enzymes, instead of the pure enzyme usually one or more solid or liquid formulations which contain a compound which catalyzes the hydrolysis of peptide bonds is metered.

Solid formulations contain, in addition to the compound or the compounds which catalyzes or catalyze the hydrolysis of peptide bonds, also inorganic or organic solids or mixtures thereof. Examples of inorganic solids are NaCl, $Na_2SO_4$, kieselguhr, $NaHCO_3$, $Na_2CO_3$ or kaolin, bentonites or clay minerals; suitable organic solids are, for example, polysaccharides, such as starch and modified starch, or urea. Solid formulations may furthermore contain reducing substances, for example $NaHSO_3$. Liquid formulations contain at least one liquid solvent or dispersant, for example water or a mixture of water and organic solvent.

The novel treatment of the animal hides is preferably effected with one or more compounds of the formula I and at least one compound which catalyzes the hydrolysis of peptide bonds, during liming or during painting, in particular under either hair-destroying or under hair-preserving conditions. Instead of the conventional concentration of from about 2 to 4% by weight of $Na_2S$ or NaHS, it is possible during liming or during painting to manage with a concentration of less than 0.1% by weight of $Na_2S$ or NaHS for an equivalent effect with regard to the removal of horny substances. In a preferred variant of the novel process, it is possible to dispense with the use of $Na_2S$ or NaHS or other foul-smelling sulfur-containing reagents.

According to the invention, the animal hides are treated in an aqueous liquor. The liquor ratio is from 1:10 to 10:1, preferably from 1:2 to 4:1, particularly preferably up to 3:1, based on the hide weight or salted weight of the animal hides.

The novel process is carried out at a pH of from 6 to 14, preferably from 7 to 12.3, particularly preferably from 7.5 to 10.5, very particularly preferably from 8.1 to 10.

The pH can be established by adding up to 3% by weight, based on the liquor, of lime (also calcium hydroxide). However, the amount-of lime may also be reduced to 0.3% by weight at the most.

In a preferred embodiment of the novel process, the use of lime is dispensed with. In the preferred embodiment, from 0.1 to 4% by weight of one or more inorganic basic alkali metal compounds is added, for example one or more hydroxides or carbonates of alkali metals, preferably of sodium or potassium, very particularly preferably of sodium. Other suitable inorganic basic alkali metal compounds are alkali metal silicates. Instead of basic alkali metal compounds, it is possible to add magnesium oxide, magnesium hydroxide, amines, for example ammonia, methylamine, dimethylamine, ethylamine or triethylamine, or combinations of alkali metal compound and one or more amines.

In addition to water, organic solvent may be present in the liquor, for example up to 20% by volume of ethanol or isopropanol.

The novel process can be carried out in vessels in which liming is usually effected. Preferably, the novel process is carried out in rotatable drums having baffles. The speed is usually from 0.5 to 100/min, preferably from 1.5 to 15/min, particularly preferably up to 5/min. If liming is to be effected over a period of more than 8 hours, the speed is usually from 0.5 to 10/min, preferably 1.5 to 5/min, particularly preferably up to 3/min for 5 minutes within each hour, i.e. rotation for 5 minutes and a pause for 55 minutes per hour.

The pressure and temperature conditions for carrying out the novel process are generally not critical. It has proven suitable to carry it out at atmospheric pressure; a pressure up to 10 bar is also conceivable. Suitable temperatures are from 10 to 45° C., preferably from 15 to 35° C., particularly preferably from 25 to 30° C.

The compound or the compounds of the formula I can be metered at the beginning of the liming process, but the animal hides can first be soaked under basic conditions and one or more compounds of the formula I and at least one compound which catalyzes the hydrolysis of peptide bonds can be metered in only after some time. The metering can be effected in one step, i.e. the total amount of the compound or compounds I used is metered in one step; compound I can also be metered in portions or continuously. It is also possible to employ at least one compound which catalyzes the hydrolysis of peptide bonds. Compound I and the compound which catalyzes the hydrolysis of peptide bonds can be metered together or separately.

The novel process can be carried out within a period of from 5 minutes to 48 hours, preferably from 10 minutes to 36 hours, particularly preferably from 20 minutes to 15 hours.

In one embodiment of the present invention, organic polyelectrolytes can be added.

Organic polyelectrolytes are generally understood as meaning organic polymers which have a large number of groups which are capable of ionic dissociation and may be an integral part of the polymer chains or may be attached as side groups to said chains. In general, each of the random repeating units carries at least one group capable of ionic dissociation in aqueous solution. In the present invention, ionomers are also included among the organic polyelectrolytes, said ionomers being those organic polymers in which many repeating units carry a group capable of ionic dissociation, but not every unit carries such a group. Polymers having only one or two ionizable groups at the respective chain ends or, in the case of branched polymers, a number of groups capable of dissociation which corresponds to the number of chain ends are not included among polyelectrolytes in the context of the present invention.

In the novel process, polybases, polyacids, polyampholytes or the polysalts or mixtures thereof may be used. Polyacids are to be understood as meaning those organic polyelectrolytes which dissociate in an aqueous medium with elimination of protons, for example having polyvinylsulfonic acid, polyvinylsulfuric acid, polyvinylphosphonic acid, polymethacrylic acid or polyacrylic acid as a random repeating unit. Polybases are to be understood as meaning those organic polyelectrolytes which contain groups or radicals which can be protonated by reaction with Brönsted acids, for example polyethylenimines, polyvinylamines or polyvinylpyridines. Polyampholytes are usually understood as meaning those polymers which contain both repeating units which dissociate in an aqueous medium with elimination of protons and repeating units which can be protonated by reaction with Brönsted acids. Polysalts are usually understood as meaning singly or in particular multiply deprotonated polyacids.

Synthetic polyelectrolytes are preferably used in the novel process.

Of course, assistants customary in the tannery may also be added for carrying out the novel process, for example phosphines, e.g. triphenylphosphine or tri(2-carboxyethyl) phosphine hydrochloride, and furthermore hydroxylamine, urea, guanidine or guanidinium hydrochloride, hydrazine, biocides, surfactants and emulsifiers.

By means of the novel process, it is possible to produce excellently unhaired pelts. It is also found that the epidermis is completely or at least substantially detached after only a short duration of treatment. It is furthermore found that, particularly in the treatment of animal hides of completely or partly black animals, for example Friesian cattle, a substantial proportion of melanin or even all melanin is also destroyed or removed from the pelts, so that particularly pale pelts are obtained. The present invention therefore relates to particularly pale pelts, produced by the novel process.

It has furthermore been found that the pelts produced according to the invention are very useful for the production of leather. After the novel pelts have been further processed by methods customary in the tannery, i.e. bating, if required deliming, pickling, chrome-free tanning or chrome tanning, retanning and finishing, it is observed that the pelts produced according to the invention can be further processed to leather with an improved yield in terms of area and less swelling damage compared with leather produced from pelts which were unhaired with the aid of, for example, $Na_2S$, NaHS, thioglycolic acid or aminoethanol. Moreover, it is possible to effect particularly level dyeing of the pelts produced according to the invention. If the use of lime is dispensed with in the novel process, novel pelts free of lime blast and having particularly flat and smooth grain are obtained.

Only slightly, preferably no, conversion to nubuck-type leather is observed.

In a preferred embodiment, the bating step can be dispensed with in the further processing.

The present invention furthermore relates to leathers produced from novel pelts. Overall, they have advantageous performance characteristics.

It has furthermore been found that the wastewaters formed in the novel process, in particular wastewaters of novel processes in which $Na_2S$, NaSH or a mercaptan, such as aminoethanol or thioglycolic acid, is not employed, can be particularly readily worked up. After the end of the action of one or more compounds of the formula I and of one or more compounds which catalyze the hydrolysis of peptide bonds on animal hides, the resulting pelts are separated from the liquor, for example by simply taking out the pelts or by draining the liquor. The liquor separated off is subsequently also referred to as novel residual liquor or as residual liquor. The residual liquor contains, inter alia, reacted and possibly unconsumed compound of the formula I, in addition to basic alkali metal compound or basic amines or lime and in particular residues of the horny materials separated from the pelts and of the epidermis and may contain melanin and/or degradation products of melanin. In a preferred embodiment, the novel residual liquor contains no noticeable amounts of compound of the formula I.

The present invention furthermore relates to residual liquors which contain only small amounts of $Na_2S$ and preferably neither $Na_2S$ nor NaHS, and, as organic sulfur compounds, those of the formula I and the reaction and secondary products thereof from the removal of horny substances from animal hides, and organic sulfur compounds which originate from the animal hides. The novel residual liquors may now contain melanin and/or degradation products of melanin and melamine and/or degradation products of melamine. Moreover, the salt load is considerably reduced by using the process at a pH of less than 12.4, in particular at a pH of from 7 to 10. This is possible in particular when the use of lime is dispensed with. The novel liquors are obtainable by the novel process. In comparison with the residual tannery liquors known from the prior art, they are virtually odorless and particularly simple to work up.

The residual liquors contain reaction products and secondary products of compounds of the formula I which result from the removal of horny substances from the animal hides, mainly hydrolysis and oxidation products of compounds of the formula I, and proteins hydrolyzed with the aid of an organic compound.

It has been found that the novel residual liquors are particularly easy to work up.

The present invention furthermore relates to a process for working up novel residual liquors. The novel working-up process comprises a plurality of steps.

In a first, optional step, the novel pelts are separated from the lime. This step is by its very nature required only when lime has been used in the treatment of the animal hides, but is otherwise not required. The separation is effected by settling, flotation, decanting, filtration or centrifuging, the separation of the lime by decanting, settling or filtration being preferred in the case of large amounts of novel residual liquors. By means of the first step described above, lime-free residual liquors are obtainable.

The lime-free residual liquors are then neutralized with acid, until a pH of from 2 to 8, preferably from 3 to 7, particularly preferably from 4 to 5, is reached.

Suitable acids are organic or inorganic acids. Examples are hydrochloric acid, phosphoric acid, $CO_2$, formic acid, sulfuric acid, acetic acid, citric acid, adipic acid and dicarboxylic acid mixtures comprising adipic acid, glutaric acid and succinic acid. Acidification can be effected without particular measures with regard to evolving hydrogen sulfide.

The proteins removed during liming or during painting of the pelt are precipitated or float, so that they are separated off mechanically in a further step, for example by filtration or flotation.

It was furthermore found that, after neutralization and removal of the proteins, novel residual liquors can be used in an outstanding manner for soaking raw hides. The present invention therefore relates to the use of the novel neutralized residual liquors freed from proteins as a medium for soaking raw hides. The present invention moreover relates to a process for working up novel residual liquors by neutralization and removal of proteins.

The working examples which follow illustrate the invention.

GENERAL

Determination of the LVU

Hammarsten casein (commercially available from E. Merck, Art. 2242) in the form of a 4% by weight solution was used.

A 4% by weight solution of casein was prepared by diluting 40 g of casein at up to 60° C. with 800 ml of distilled water and 32 ml of 1 N NaOH, mixing being effected until precipitates or undissolved solids were no longer present. The solution was cooled to 25° C. and brought to a pH of 8.2 with 0.1 N NaOH or 0.1 N HCl. Dilution to 1 000 ml with distilled water was then effected.

50 ml of the casein solution described above were mixed with 10 ml of the formulation to be investigated and comprising the compound(s) which catalyzes or catalyze the hydrolysis of peptide bonds, and the pH was brought to 8.2 with 0.1 N NaOH or 0.1 N HCl. After 60 minutes at 37° C. the reaction was stopped by adding 20 ml of 0.1 N HCl and 20 ml of 10% by weight $Na_2SO_4$ solution, any precipitate formed was filtered off and a 20 ml sample was taken and titrated with 0.1 N NaOH against phenolphthalein.

A blank sample was prepared by mixing the abovementioned reagents without adding the formulation to be investigated and comprising the compound(s) which catalyzes or catalyze the hydrolysis of the peptide bonds. The further procedure was as described above. The difference between the consumptions of NaOH, multiplied by 17.39 and divided by the enzyme mass used in g, corresponds to the LVU/g.

Below, all data in % by weight are based on the salted weight, unless stated otherwise.

General Working Methods

1. SOAKING

Soaking with the Use of Water

The salted South German cattle hide was first presoaked at 28° C. with 150% by weight of water and 0.2% by weight of $C_{15}H_{31}$—O—($CH_2$—$CH_2$—O)$_7$—H for 120 minutes in a drum with gentle agitation. The liquor was discharged (X1-1 Presoaking liquor, 200% by weight) and then-soaking was effected with 100% by weight of water, 0.2% by weight of $C_{15}H_{31}$—O—($CH_2$—$CH_2$—O$_7$—H and 0.5% by weight of $Na_2CO_3$ with occasional ag for 19 hours. The liquor was then discharged (X1-2 Main soaking liquor, 100% by weight).

2. HAIR-DESTROYING LIMING OF COMPARATIVE EXAMPLE V1

For comparative example V1, 100 parts by weight, based on salted weight, were treated in succession with 80 parts by weight of water and 1.0% by weight of mercaptoethanol in a rotatable 10 I drum containing baffles. After 30 minutes, 0.8% by weight of NaSH (70% by weight) and 1% by weight of calcium hydroxide followed for a further 30 minutes. 0.75% by weight of sodium sulfide and 0.75% by weight of sodium sulfide together with 1.0% by weight of lime followed at an interval of 30 minutes. The drum was operated for a further 30 minutes at 15 revolutions/minute. A further 70 parts by weight and 1.0% by weight of lime were then metered. After 10 hours at from 23 to 27° C. and 5 minutes per hour at 3 revolutions/minute, the experiments were terminated by discharging the liquor (sample V1-3 Liming liquor, 150% by weight) and washing the pelt once for 15 minutes with 150 parts by weight of water (sample V1-4 Liming wash liquor, 150% by weight).

Before the further processing, the pelt was fleshed and split (2.8 mm).

2.1. Further Processing of the Pelt According to Comparative Example V1 in the Deliming Below, the data in % by weight were based on the pelt weight, grain split, 2.8 mm (corresponds to 75% of salted weight), unless stated otherwise. The deliming was carried out at from 25 to 32° C. Experimental parameters are shown in table 1.

TABLE 1

Experimental parameters of the further processing of the pelt from VI

| Experiment | Amount [% by wt.] | Product | pH | Time [min] |
|---|---|---|---|---|
| V1 | 150 | Water, 2× Discharge liquor (V1-5/V1-6 Deliming wash liquor, 300% by weight) | | 20 |
| | 100 | Water | | |
| | 0.2 | Deliming agent Decaltal ® ES-N, commercially available from BASF Aktiengesellschaft | | |
| | 0.2 | $C_{15}H_{31}$—O—($CH_2CH_2$—O)$_7$—H (diluted 1:3) | | |
| | 0.2 | $NaHSO_3$ Discharge liquor (V1-7 Deliming liquor, 100% by weight) | 8.6 | 20 |
| | 50 | Water | | |
| | 1.0 | Deliming agent Decaltal ® ES-N, commercially available from BASF Aktiengesellschaft | 8.0 | 45 |
| | 1.0 | Basozym ® C10, 1000 LVU/g Discharge liquor (V1-8 Bating liquor, 50% by weight) | | 45 |
| | 150 | Water Discharge liquor (V1-9 Bating wash liquor, 100% by weight) | | 10 |

The penetration of the neutralization over the hide cross section was checked using phenolphthalein as indicator. The time required for this purpose was noted.

2.2. Pickling and Tanning of the Pelt According to Comparative Example V1

Below, the data in % by weight are based on the pelt weight, grain split, 2.8 mm (corresponds to 75% of salted weight) unless stated otherwise.

40% by weight of water and 6% by weight of NaCl (8° Be) were added to 100% by weight of the respective novel pelt E1 to E6 in a rotatable 10 I drum containing baffles. After 10 minutes, 1.0% by weight of the fatliquoring agent Lipoderm Licker® A1, commercially available from BASF Aktiengesellschaft, was added and, after 20 minutes, 0.4% by weight of aqueous formic acid (20% by weight) was introduced. After 30 minutes, 0.8% by weight of 98% by weight sulfuric acid was added; the pH was 3.0. After a further 90 minutes, 2.5% by weight of a dispersion of Relugan® GTP, diluted in the volume ratio of 1:3 with water, 3.0% by weight of a dispersion of the syntan tanning agent Basyntan® SW liquid diluted in the volume ratio 1:2 with water (both reagents commercially available from BASF Aktiengesellschaft) and 2.0% by weight of a naphthalenesulfonic acid/formaldehyde condensate, prepared according to U.S. Pat. No. 5,186,846, example Dispersant 1, were added. Said substances were allowed to act for 90 minutes with occasional rotation and basification was effected with 0.2% by weight of sodium formate to a pH of 3.9. After a contact time of 15 hours, a further 0.2% by weight of sodium formate and 0.2% by weight of $NaHCO_3$ were added. The pH was now 4.0. After a further 90 minutes, 0.2% by weight of a dispersion of the fungicide Cortymol® Fun, diluted in the volume ratio of 1:3 with water, was added.

After the end of the action, the residual liquor was discharged, and the residual liquor V-0 was obtained.

3. EXAMPLES E1 to E7 ACCORDING TO THE INVENTION

3.1. Hair-destroying Liming of Examples E1 to E7 According to the Invention

For examples E1 to E5 according to the invention, 100 parts by weight, based on salted weight, were treated with 50 parts by weight of water in a rotatable 10 I drum containing baffles. The drum was rotated. Thereafter, the amount of enzyme shown in table 2 and, after 60 minutes, the amount of racemic dithiothreitol (DTT) shown in table 2 were added. The pH was 7.5. After the time shown in table 2, NaOH solution (50% by weight in water) was added as Base 1. The pH increased to the valued stated in the table. In examples E1 to E5, in each case the amount of NaOH solution (50% by weight in water) stated in table 2 was also metered in as Base 2, the pH increasing to the value stated in the table.

The drum was rotated in each case for 5 minutes at 5 rpm and left stationary for 55 minutes, after which the movement cycle was repeated. After a contact time of 10 hours, 50% by weight of water were added, the liquor was discharged, 150% by weight of water were introduced, movement was effected for 10 minutes and the wash liquor was again discharged.

Example E6 was carried out analogously, except that NaOH solution was replaced by solid MgO and the subsequent metering of base was dispensed with.

Example E7 was carried out analogously, except that the addition of base was dispensed with.

TABLE 2

Experimental parameters of liming of the examples according to the invention

| Example | E1 | E2 | E3 | E4 | E5 | E6 | E7 |
|---|---|---|---|---|---|---|---|
| Enzyme | Basozym L10 | Pyrase 250 mp | Alcalase 3.0t | Alcalase 3.0t | Basozym L10 | Basozym L10 | Basozym L10 (a) and Basozym S20 (b) |
| Amount of enzyme [% by wt.] | 2.0 | 0.006 | 0.016 | 0.008 | 1.0 | 2.0 | 1.5 (a) 0.4 (b) |
| LVU/g | 1000 | 350000 | 250000 | 250000 | 1000 | 1000 | 1000 (a) 2000 (b) |
| DTT [% by wt.] | 0.75 | 0.75 | 0.75 | 0.75 | 1.5 | 0.75 | 1.5 |
| Base 1 [% by wt.] | 1.5 | 1.5 | 1.5 | 2.0 | 2.0 | 1.0 | — |
| pH | 10.7 | 10.7 | 10.7 | 12.1 | 12.1 | 10.5 | 8.5 |
| Time[h] | 3 | 3 | 3 | 0.5 | 0.5 | — | 0.5 |
| Base 2 [% by wt.] | 1.5 | 1.5 | 1.5 | 0.4 | 0.4 | — | — |
| pH | 12.4 | 12.4 | 12.4 | 12.4 | 12.4 | 10.5 | 8.5 |
| Liming liquor | E1-3 | E2-3 | E3-3 | E4-3 | E5-3 | E6-3 | E7-3 |
| Liming wash liquor | E1-4 | E2-4 | E3-4 | E4-4 | E5-4 | E6-4 | E7-4 |

Basozym L 10 occasionally referred to as Basyzym L 10; proteolytic enzyme preparation containing 1000 LVU/g.

The novel pelts B E1 to B E7 were obtained.

Before the further processing, the pelts were fleshed and split (2.8 mm).

3.2. Pickling and Tanning of the Pelts of Examples E1 to E7 According to the Invention Below, the data in % by weight are based on the pelt weight, grain split, 2.8 mm (corresponds to 75% of salted weight), unless stated otherwise.

40% by weight of water and 6% by weight of NaCl (8° Be) were added to 100% by weight of the respective novel pelt E1 to E6 in a rotatable 10 I drum containing baffles. After 10 minutes, 1.0% by weight of the fatliquoring agent Lipoderm Licker® A1, commercially available from BASF Aktiengesellschaft, was added and, after 20 minutes, 0.4% by weight of aqueous formic acid schaft and, after 20 minutes 0.4% by weight of aqueous formic acid (20% by weight) was introduced. After 30 minutes, 0.8% by weight of 98% by weight sulfuric acid was added; the pH was 3.0. After a further 90 minutes, 2.5% by weight of a dispersion of the leather dye Relugan® GTP, diluted in the volume ratio of 1:3 with water, 3.0% by weight of a dispersion of the syntan tanning agent Basyntan® SW liquid diluted in the volume ratio 1:2 with water (both reagents commercially available from BASF Aktiengesellschaft) and 2.0% by weight of a naphthalenesulfonic acid/formaldehyde condensate, prepared according to U.S. Pat. No. 5,186,846, example Dispersant 1, were added. Said substances were allowed to act for 90 minutes with occasional rotation and basification was effected with 0.2% by weight of sodium formate to a pH of 3.9. After a contact time of 15 hours, a further 0.2% by weight of sodium formate and 0.2% by weight of $NaHCO_3$ were added. The pH was now 4.0. After a further 90 minutes, 0.2% by weight of a dispersion of the fungicide Cortymol® Fun, diluted in the volume ratio of 1:3 with water, was added.

After the end of the action, the residual liquor was discharged, and the residual liquors E1-5 to E6-5 and the novel leathers L E1 to L E6 were obtained.

4. ASSESSMENT OF THE PELTS ACCORDING TO COMPARATIVE EXAMPLE B V1 AND OF EXAMPLES B E1 TO B E7 ACCORDING TO THE INVENTION AND OF THE LEATHERS ACCORDING TO COMPARATIVE EXAMPLES L V1 AND ACCORDING TO EXAMPLES L E1 TO L E7 ACCORDING TO THE INVENTION

The leathers produced according to the invention have a smoother and flatter grain, without visible conversion to nubuck-type leather, in comparison with the leather according to the comparative example.

The epidermis and the hairs with hair root had been completely removed from the pelts of the examples according to the invention or destroyed. Particularly striking and advantageous was the very pale appearance of the novel pelts. The bluish shadows customary for lime/sodium sulfide liming (reaction of sulfide with iron ions) and lime blast, which can lead to nonlevel dyeings, in particular in the case of pale hues, were completely absent. Furthermore, the properties of the pelts produced according to the invention were excellent with respect to swelling.

5. FURTHER PROCESSING OF THE LEATHER ACCORDING TO COMPARATIVE EXAMPLE L V1 AND ACCORDING TO EXAMPLES L E1 TO L E7 ACCORDING TO THE INVENTION IN RETANNING

The following polymers were used:

Polymer 1: Alternating copolymer of ($C_{20}$-$C_{24}$-α-olefin)/maleic anhydride; molar comonomer fraction of the (sum of the α-olefins): maleic anhydride 1:1, $M_w$ 8 900 g, preparation described in EP 0 412 389 B1 as dispersion I. Form used: 30.2% by weight of dispersion.

Polymer 2: 30% strength by weight aqueous polymer solution partly neutralized with NaOH; homopolymer of methacrylic acid, $M_n$ about 10 000 g/mol; Fikentscher K value: 12, viscosity of the 30% by weight solution: 65 mPa.s (DIN EN ISO 3219, 23° C.), pH 5.1.

The leathers obtained according to 3. were sammed and shaved by conventional methods. The shaved thickness of the leathers was 2.0-2.2 mm (shaved weight corresponds to 25% of salted weight). The retanning was effected as follows:

The pretanned leather L V1 or L E1 to L E6 was treated, at a liquor length of 100% by weight of water at 30° C., with 15% by weight of polymer 1 as a 30.2% by weight aqueous dispersion and 15% by weight of a 30% by weight aqueous dispersion of polymer 2 (action step (a), cf. table 4). Thereafter, the commercial dye Luganil® Black AS liquid was added to the leather. A further 10% by weight of polymer 1 in the form of 30.2% strength by weight aqueous dispersion and 2% by weight of polymer 2 in the form of a 20% by weight dispersion were then added. The leather remained for the time stated in table 4 in the liquor thus formed (action step (b)).

The reaction temperature was then increased by adding 100% of water at 45° C. A pH of 3.5 was established with formic acid. The leather remained for the time stated in table 4 in the liquor thus formed (action step (c).

Finally, the leather was dyed with a solution of 1.5% by weight of Luganil® Black AS liquid in 100% by weight of water and 0.7% by weight of formic acid over a period of 45 minutes, and then washed, fixed and finished in the customary manner. The finished crust leathers C V1 (comparative example) and C E1 to C E6 (according to the invention) were obtained.

The process parameters are shown in table 3.

TABLE 3

Process parameters of the action steps in the retanning

| | L V1, L E1 to L E7 |
|---|---|
| Action step (a) | |
| Polymers | 1 and 2 |
| Duration | 90 min |
| Action step (b) | |
| Polymers | 1 and 2 |
| Duration | 180 min |
| Action step (c) | |
| Polymer | — |
| Duration | 20 min |

The physical properties and the performance characteristics were then tested.

6. ASSESSMENT OF THE FINISHED LEATHERS C V1 AND C E1 TO C E6

The crust leathers produced from the examples according to the invention differ from the comparative example in their haptic and optical properties through the smoother and finer grains. Leather having very good dyeing and tight grain in combination with very good body and excellent softness with elegant handle is obtained. The values are shown in table 4.

TABLE 4

Performance characteristics of crust leathers C V1 and C E1 to C E6

| Example | Unhairing activity | Grain tightness Wet white leather | Stitch tear resistance according to DIN 53331 [N] |
|---|---|---|---|
| C V1 | 2 | 2 | 140 |
| C El | 1 | 1 | 172 |
| C E2 | 1 | 1 | 178 |
| C E3 | 1 | 1 | 180 |
| C E4 | 1 | 1 | 187 |
| C E5 | 1 | 1 | 190 |
| C E6 | 1 | 1 | 181 |
| C E7 | 1 | 1 | 195 |

The unhairing activity and the grain tightness were assessed visually using ratings from 1 (very good) to 6 (inadequate).

7. WORKING UP THE RESIDUAL LIQUORS

General working method using the example of the residual liquors according to example E1

The liming liquor E1-3 and liming wash liquor E1-4 were combined and were brought to a pH of 4.5 with concentrated sulfuric acid (98% by weight). The precipitated protein was separated off using a chamber filter press. The data of the combined and purified liquors E1-3 and E1-4 are shown under 8.1 (liquor E1-A). The purified liming liquors were very useful as soaking liquors. The water consumption can be considerably reduced therewith.

The residual liquors of the examples according to the invention could be acidified to a pH of 4.5 with sulfuric acid without evolution of hydrogen sulfide, and the precipitated protein could be separated off without problems by filtration. The residual liquors were moreover virtually clear.

The liquor according to comparative experiment V1 could not be acidified without precautions and evolved foul-smelling hydrogen sulfide. Even after working up, it could not be used for soaking cattle hides.

8. ANALYTICAL RESULTS OF THE RESIDUAL LIQUORS AND WASTEWATERS

TABLE 5

Analytical results of the residual liquors and wastewater

| Experiment | Water consumption up to tanning [$m^3$] | Water consumption up to tanning [rel. %] | COD [mg $O_2$/l] | $COD_{total}$ [kg $O_2$] | COD [rel. %] |
|---|---|---|---|---|---|
| V1 | 10.30 | 100 | 13200 | 136.2 | 100 |
| E1 | 2.80 | 27 | 15500 | 43.4 | 31 |
| E2 | 2.80 | 27 | 16800 | 47.0 | 34 |
| E3 | 2.80 | 27 | 18900 | 52.9 | 38 |
| E4 | 2.80 | 27 | 18900 | 52.9 | 38 |
| E5 | 2.80 | 27 | 19000 | 53.2 | 38 |
| E6 | 2.80 | 27 | 17300 | 48.4 | 35 |
| E7 | 2.80 | 27 | 18700 | 52.8 | 38 |

COD: chemical oxygen demand

8.1. Protein Precipitate According to E1-E6

In each case about 100-150 kg, solids content 30% by weight, COD [kg $O_2$/kg]83.3-92.8, ash content 1.0-1.4%

8.2. Worked-Up and Reused Liquor Liquors for Example E1

TABLE 6

Analytical values of the worked-up residual liquors E1-A

| Liquor | Process | pH | Solids content [%] | Ash [% by wt.] | COD [mg $O_2$/l] | Liquor [% by wt.] |
|---|---|---|---|---|---|---|
| E1-A | E1-3 + E1-4 (before neutralization) | 12.4 | 7.8 | 0.8 | 44300 | 250 |
| E1-A | E1-3 + E1-4 (after neutralization, after filtration) | 4.5 | 5.7 | 2.6 | 6200 | 250 |

8.3. Use of Neutralized Residual Liquors Freed from Protein

Soaking Using Neutralized Residual Liquors Freed from Protein

Method 1.1 was repeated with a salted South German cattle hide, but water was replaced by the neutralized residual liquor freed from protein and described under 7.

The soaked hide was then further processed similarly to E1. A crust leather having the same properties as C E1 was obtained.

We claim:

1. A process for removing horny substances from an animal hide, comprising:

treating an animal hide with an aqueous liquor, whereby horny substances are removed from said animal hide, and wherein said aqueous liquor has a pH of from 7 to 12.3 and contains lime which is present in an amount not greater than 0.3% by weight, and which aqueous liquor comprises from 0.05 to 5% by weight, based on the salted weight of said animal hide, of one or more compounds of the following formula I:

I

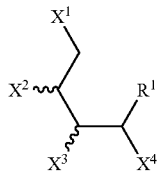

or a corresponding alkali metal or alkaline earth metal or ammonium or phosphonium salts thereof, the variables being defined as follows:

$R^1$ is selected from the group consisting of hydrogen and $C_1$-$C_{12}$-alkyl, unsubstituted or substituted by one or more S—H or O—H groups;

$X^1$ to $X^4$ are identical or different and are selected from the group consisting of hydrogen, $C_1$-$C_4$-alkyl, O—H, S—H and N—$R^2$;

$R^2$ is hydrogen or $C_1$-$C_{12}$-alkyl or a $C_1$-$C_4$-alkyl-C═O group;

at least one of the radicals $X^1$ to $X^4$ being S—H;

and, if $R^1$ contains neither O—H nor S—H, at least one further radical from among $X^1$ to $X^4$ is selected from the group consisting of S—H, OH and NH–$R^2$;

and further comprising at least one compound which catalyzes a hydrolysis of peptide bonds.

2. The process as claimed in claim 1, wherein said at least one compound which catalyzes said hydrolysis of peptide bonds is an organic compound.

3. The process as claimed in claim 1, wherein said at least one compound which catalyzes said hydrolysis of peptide bonds is an enzyme.

4. The process as claimed in claim 3, wherein said enzyme is a protease or a peptidase.

5. The process as claimed in claim 1, wherein said at least one compound which catalyzes said hydrolysis of peptide bonds has Löhlein and Volhard activity from 500 to 2,000,000 LVU/kg, based on the salted weight of said animal hide.

6. The process as claimed in claim 1, wherein $R^1$ is H, $X^1$ and $X^4$ are S—H, and $X^2$ and $X^3$ are O—H.

7. The process as claimed in claim 1, wherein the amount of said at least one compound which catalyzes said hydrolysis of peptide bonds is chosen to be a factor of at least 10 smaller than the amount of said one or more compounds of formula I.

8. The process as claimed in claim 1, wherein said process is carried out in the presence of urea.

9. The process as claimed in claim 1, further comprising the steps of obtaining a residual liquor, wherein the residual liquor is separated off from lime and then neutralized with acid and then, proteins are separated off.

10. A process for soaking raw hides comprising soaking a raw hide with said neutralized residual liquor as claimed in claim 9.

11. The process as claimed in claim 1, wherein the pH is from 7.5 to 10.5.

12. The process as claimed in claim 1, wherein the pH is from 8.1 to 10.

13. The process as claimed in claim 1, wherein said animal hide contains an epidermis, and at least partial detachment of the epidermis from said animal hide is carried out by said process.

14. A process for removing horny substances from an animal hide, comprising:

treating an animal hide with an aqueous liquor, whereby horny substances are removed from said animal hide, and wherein said aqueous liquor contains lime which is present in an amount not greater than 0.3% by weight, and which aqueous liquor comprises from 0.05 to 5% by weight, based on the salted weight of said animal hide, of one or more compounds of the following formula I:

I

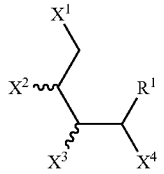

or a corresponding alkali metal or alkaline earth metal or ammonium or phosphonium salts thereof, the variables being defined as follows: $R^1$ is selected from the group consisting of hydrogen and $C_1$-$C_{12}$-alkyl, unsubstituted or substituted by one or more S—H or O—H groups; $X^1$ to $X^4$ are identical or different and are selected from the group consisting of hydrogen, $C_1$-$C_4$-alkyl, O—H, S—H and N—$HR^2$;

$R^2$ is hydrogen or $C_1$-$C_{12}$-alkyl or a $C_1$-$C_4$-alkyl-C═O group;

at least one of the radicals $X^1$ to $X^4$ being S—H;

and, if $R^1$ contains neither O—H nor S—H, at least one further radical from among $X^1$ to $X^4$ is selected from the group consisting of S—H, OH and NH—$R^2$;

and further comprising at least one compound which catalyzes a hydrolysis of peptide bonds, wherein the amount of said at least one compound which catalyzes said hydrolysis of peptide bonds is chosen to be a factor of at least 10 smaller than the amount of said one or more compounds of formula I.

* * * * *